US007137926B2

(12) United States Patent
Barrows

(10) Patent No.: US 7,137,926 B2
(45) Date of Patent: Nov. 21, 2006

(54) FOAM ROLLER

(76) Inventor: Stacy Barrows, 1633 5th St., Manhattan Beach, CA (US) 90266

( * ) Notice: Subject to any disclaimer, the term of this patent is extended or adjusted under 35 U.S.C. 154(b) by 0 days.

(21) Appl. No.: 10/801,735

(22) Filed: Mar. 16, 2004

(65) Prior Publication Data

US 2005/0209074 A1 Sep. 22, 2005

(51) Int. Cl.

| | |
|---|---|
| ***A63B 22/00*** | (2006.01) |
| ***A63B 22/10*** | (2006.01) |
| ***A47C 20/00*** | (2006.01) |

(52) U.S. Cl. ..... 482/51; 482/79; 5/636

(58) Field of Classification Search ..... 482/77, 482/79, 140–142, 148, 51; 5/636, 648; D6/595, D6/601; D24/183
See application file for complete search history.

(56) References Cited

U.S. PATENT DOCUMENTS

| | | | | | |
|---|---|---|---|---|---|
| 1,274,595 | A | * | 8/1918 | Ranz | 5/636 |
| 1,468,268 | A | * | 9/1923 | Karr | 5/491 |
| D259,689 | S | * | 6/1981 | Handel | D6/502 |
| D330,989 | S | * | 11/1992 | Evans | D6/601 |
| D374,146 | S | * | 10/1996 | Bonaddio et al. | D6/601 |
| 5,713,841 | A | * | 2/1998 | Graham | 5/636 |
| 5,802,644 | A | * | 9/1998 | Scheurer | 5/640 |
| D435,751 | S | * | 1/2001 | Koshaba | D6/601 |
| 6,272,703 | B1 | * | 8/2001 | Swezey et al. | 5/640 |
| D457,771 | S | * | 5/2002 | Boxrud | D6/601 |

* cited by examiner

*Primary Examiner*—Jerome Donnelly
*Assistant Examiner*—Tam Nguyen
(74) *Attorney, Agent, or Firm*—Kimberly & Lerner, LLP; Michael D. Harris; Marvin H. Kleinberg

(57) ABSTRACT

The outside of an elongated exercise roller formed of a compressible, foam material, is modified. Instead of being cylindrical, a portion of the outside has a gentler curvature over part. That change makes balancing easier.

14 Claims, 1 Drawing Sheet

FOAM ROLLER

BACKGROUND OF THE INVENTION

1. Field of the Invention

The present invention relates to foam rollers that are used for exercise, balance and movement awareness.

2. General Background and State of the Art

Many physical therapists and exercise trainers recognize the benefits of core strength, balance and movement awareness. By core strength, trainers and persons exercising refer to strength of the muscles, primarily in the abdominal and back area. Thus, exercises that facilitate balance, develop good posture and emphasize movement awareness are considered valuable exercises. In addition, many gyms come equipped with devices that rely on balance for proper use. As particular exercises force a person to balance and assume proper posture, the many muscles used to maintain balance and posture strengthen. These stronger muscles improve a person's balance and posture. Thus, exercises that force persons to balance and have good posture are considered valuable exercises.

In addition, better balance helps to avoid injury, especially in the elderly. Good posture also makes injury during exercises or daily activities less likely.

Many exercise devices are used to improve balance. The BOSU is one example. It has a hard, flat, rubberized side and an inflated dome on the opposite side. The user may stand on either side of the BOSU and balance. People also sit on the dome side and perform abdominal exercises. In another exercise, users mount the dome side down and perform balancing pushups with their hands on the flat side.

A disk with curved top and bottom surfaces is another balance device. Some people also use soft foam blocks about 1 foot (30 cm) square and 1 or 2 inches (2.5–5 cm) thick (metric conversions are approximate). The block's resiliency makes balancing more difficult and forces a user to concentrate on balancing.

Many gyms have inflatable balls of different diameters between about 1.5 and 2 feet (45–65 cm). People use them for sit-ups and other abdominal exercises. In another exercise, the user places his or her hands on the floor with legs on the ball. Drawing the knees toward the chest exercises the back and abdominal muscles. In addition, some do push-ups with the legs or feet on the ball and the hands on the floor. The ball adds the element of balance to common sit-ups and push-ups. Still other use the ball purely for balance by kneeling on the ball and maintaining balance.

Wobble boards and similar devices also improve balance. They have a flat board mounted on a narrow block or roller, and the user balances the board above the block.

The Core Board is a platform mounted on a base. The mounting allows the platform to tilt to all angles and directions. The platform also can pivot about the base. The mounting is resilient so that the platform returns to its original position when no force acts on it. The device is said to be active with dynamic response to movement.

Therapeutic or exercise foam rollers are another prior art device. They typically are about 3 feet long (0.9 m) and about 6 inches (15 cm) in diameter. Shorter versions are available. The user can stand or walk on it for balance. Alternatively, the user lies on the roller with the roller axis aligned with the spine. The 6-inch diameter raises the person's shoulders and back above the floor or mat and forces him or her to balance. Depending on the person's height, the roller's 3 foot length is usually long enough to support the head and still extend to the hips. From the supine position, the user can perform abdominal crunches, leg lifts, and arm, chest and other exercises. The user's feet remain on the ground for many exercises. During the exercise, the person must continually adjust for balance on the roller. This forces the user to engage and ultimately strengthen many different muscles.

Instead of a circular cross-section, some rollers' sections are semi-circular. Other rollers are available with different diameters or lengths.

Foam rollers provide excellent "prompts" and are especially helpful in core stability retraining. Because foam rollers are cylindrical and inherently unstable, they challenge conscious awareness, provide sensory motor challenges, and enhance balance reactions, body awareness, muscle re-education, motor planning and neural flexibility.

Beginners can become frustrated when starting balance exercises. With many other types of exercises, one can perform beginning skills early. For example, most people who begin lifting weights for exercise can use lighter weights at first. Similarly, some who cannot jog a full mile without stopping can walk the entire mile or switch between jogging and walking while building stamina. If the person continues to train, eventually the weight he or she can lift or the percentage of jogging or running versus walking increases. Psychologically, the person progressing is more likely to continue an exercise program than one who sees no progress or cannot perform an exercise.

People may treat balance exercises differently, however. If one cannot balance at all on some of the devices, he or she may give up such exercises. Thus, initial use of balance devices that allows for successful balancing would allow a person to perform balance exercises and gain their benefit. As a result, the person would be less likely to quit such exercises.

There has been a need in the active exercise community for people to develop better sensory/movement awareness to avoid injury, facilitate better postural choices, and to improve muscular coordination.

INVENTION SUMMARY

It is an object of the present invention to provide a foam roller with which people can balance more easily than they can balance with cylindrical foam rollers. Another object of the present invention is to provide a variable roller that has two surface options for beginner and advanced strategies of balance. Because the flatter surface also can apply less pressure on the skin and muscles, the two surfaces allow more people to tolerate lying on the roller. Finally, for exercises that use the roller to support a body part while a person moves the body part along the roller, the two surfaces allow for different movement speeds and different applied forces. This provides heightened sensitivity of movement to increase movement awareness.

The exercise device of the present invention comprises an elongated roller formed of a compressible material. The curvature of the top portion is different than the curvature of the bottom portion. Thus, the top portion could have a semicircular cross-section with the center of the circle at the axis of the roller. The bottom portion also could have a circular cross-section, but the center of its circle would be spaced from the axis to provide a flatter curvature. That flatter curvature makes balancing easier. The invention contemplates different curvatures. In addition, the different curvatures may extend over more or less than half circumference.

Written or video instruction could accompany the device to show users proper use.

DETAILED DESCRIPTION OF THE PREFERRED EMBODIMENTS

Figure 1:
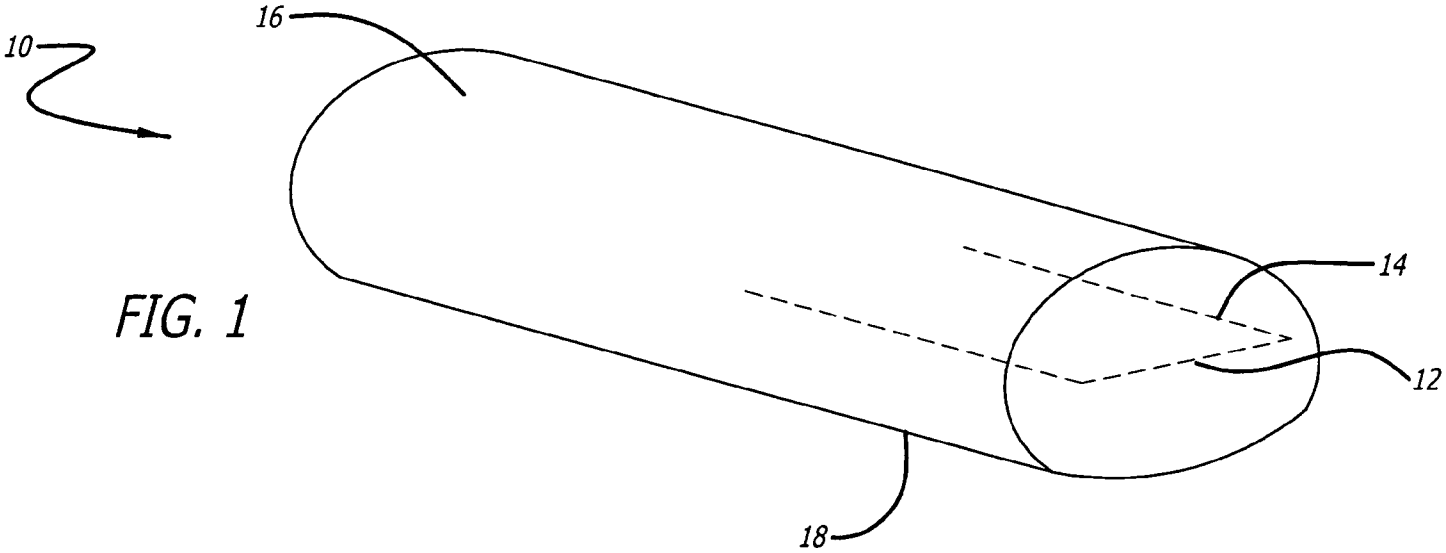
FIG. 1 is perspective view of the foam roller of the present invention.
Figure 2:
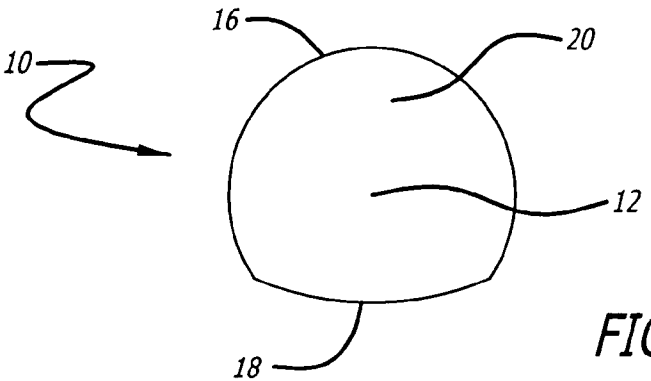
FIG. 2 is an end view of the foam roller of the present invention.

The exercise device of the present invention comprises elongated roller 10 formed of a resilient, compressible material, preferably polyethylene foam. In the exemplary embodiment, the roller is about 3 feet long and has a nominal diameter of about 6 inches. The material is standard for foam rollers. It compresses but is resilient and returns to its original shape when no force is applied.

Conventional exercise rollers are cylindrical and have a circular cross-section with a constant radius about axis. That radius is normally 3 inches (6 inch diameter) or less. Thus, conventional rollers have a constant radius.

Balancing on a conventional roller is difficult. If a person applies all his or her weight on the roller, for example, by trying to stand on it, the roller compresses and provides more surface area to the user's feet and to the floor. The roller compresses less during other exercises when the user applies part of his or her body weight on the roller. Lying supine with the roller supporting the spine is an example because the user's legs and feet often are on the ground. Even if users raise their legs, the roller compresses less because their weight is spread over move of the roller. In any event, many people find balancing difficult.

In the present invention, the curvature of the top portion 16 of the roller is different than the curvature of the bottom portion 18. In the exemplary embodiment, the top portion above lateral plane 14 has a semicircular cross-section. The center of the circle is at the axis 12 of the roller. Thus, the top half is conventional. The bottom portion 16 of the exemplary embodiment also has a circular cross-section, but the center of its circle is spaced from the axis at second axis 20. Because the radius of curvature on the bottom is longer than the radius of curvature on the top, the bottom has a flatter curvature. That flatter curvature makes balancing easier. The shapes of the top and bottom portions as shown in the drawings cause the roller to return to a first longitudinal line 22 along the bottom portion when the bottom portion is resting on a surface and force applied to the roller is released or to return to a second longitudinal line 24 along the top portion when the top portion is resting on a surface and force applied to the roller is released.

In addition, a user could lie on the flatter surface and have the regular, cylindrical surface facing downward. Because the flatter surface applies less pressure on the skin and muscles, this arrangement allows some people to tolerate lying on the roller.

Another way that the roller of the present invention improves movement awareness is to lie supine on the roller. By rocking back and forth, the user encounters changing curvatures and resulting slower or faster movement. These differences provide feedback to the use.

Another exercise that uses foam rollers involves supporting a body part with the roller and then moving the body part to cause it to traverse along the roller as the roller traverses. In one exercise, the user supports his or her thigh on the roller and then moves the leg along the roller. With applicant's present invention, the two surfaces allow for different movement speeds. This provides heightened sensitivity and increased movement awareness.

Applicant recognizes that the shape remains constant over the length of roller in the exemplary embodiment. The shape could change over its length, however. For example, if the cross-section of the roller near the center were circular but conformed to the cross-section in the exemplary embodiment (or similar modification) at the ends, a user would find balancing at the ends of the roller easier than balancing at center. That would allow a transition from the easier balancing region to the more difficult balancing region. Conversely, the ends could contain the more difficult balance region while the center could have a flatter bottom.

The roller of the present invention can be formed using several different techniques. One can start with a cylindrical roller and trim off parts of the top or bottom of the roller to have it conform to the desired shape.

Instead of achieving the desired shape by removing material from a conventional cylindrical roller, the roller could be formed with its desired shape from the beginning. Insofar as the rollers are extruded, the extrusion die would be shaped inside so that the roller conforms to the desired shape.

Applicant contemplates using circular or non-circular curves. In addition, although the curve over one portion may be circular, the curve over the other portion may be non-circular.

While the specification describes particular embodiments of the present invention, those of ordinary skill can devise variations of the present invention without departing from the inventive concept.

I claim:

1. An exercise device comprising an elongated roller formed of a compressible material and having first and second axes, a length and a sectional plane parallel to the first and second axes, the sectional plane dividing the roller into first and second portions, the first portion having a first convex outer surface that is curved about the first axis, the first surface having a first curvature with a first radius of curvature, and the second portion having a second convex outer surface that is curved about the second axis, the second surface having a second curvature with a second radius of curvature, the first and second surfaces intersecting each other, the length being substantially greater than the distance between the first and second axes, the first curvature being different than the second curvature, and wherein the first curvature is circular and the second curvature is circular, the radius of the first curvature being different from the radius of the second curvature.

2. The exercise device of claim 1, wherein the first surface has a circular cross-section and the second surface has a circular cross-section, the radius of the curvature of the first portion being different from the radius of the curvature of the second portion.

3. The exercise device of claim 1 wherein the first and second surfaces are wholly convex.

4. An exercise device comprising an elongated roller formed of a compressible material, a longitudinal axis and a length in the direction of the longitudinal axis, a sectional plane parallel to the axis, the sectional plane dividing the roller into first and second portions, a first curved, convex surface on the first portion having a first curvature with a first radius of curvature, a second curved, convex surface on the second portion having a second curvature with a second radius of curvature, the first and second curvatures allowing the first and second surfaces of the roller to roll along a generally horizontal surface, the first curvature being different than the second curvature, and the length being substantially greater than the maximum distance between the first and second surfaces of the roller, and wherein the first curvature is circular and the second curvature is circular, the radius of the first curvature being different from the radius of the second curvature.

5. The exercise device of claim 4, wherein the length of both radii is substantially less than the length of the roller in the direction of the axis.

6. The exercise device of claim 4, the roller being adapted to rest normally only on the first or second portions.

7. The exercise device of claim 4 wherein the roller has a center of gravity located within the roller such that the roller will remain on the first portion when a user positions the first portion on the horizontal surface and rolls the roller along a substantial portion of the first portion, and the center of gravity will remain on the first portion when a user positions the first portion on the horizontal surface and rolls the roller along a substantial portion of the first portion.

8. The exercise device of claim 4 wherein the first and second surfaces intersect each other.

9. The exercise device of claim 8 wherein the first and second surfaces are wholly convex.

10. An exercise device comprising an elongated roller formed of a compressible material for lying on a generally horizontal surface and having a longitudinal axis, a sectional plane parallel to the axis, and a length in the direction of the axis, the sectional plane dividing the roller into first and second portions, the first portion having a convex first curved surface and the second portion having a convex second curved surface, causes the roller to either return to rest at a first longitudinal point of contact along the first curved surface or a second longitudinal point of contact along the second curved surface when a force applied to the roller is released, and the length is substantially greater than the maximum distance between the first and second curved surfaces.

11. The exercise device of claim 10 wherein the first and second surfaces intersect each other.

12. The exercise device of claim 10 wherein the first and second surfaces are wholly convex.

13. An exercise device comprising an elongated roller formed of a compressible material, a wholly convex outer surface, a longitudinal axis and a length in the direction of the axis, a curved first surface on one side of the axis, the first surface having a first curvature with a first radius of curvature and a center and a curved second surface on the other side of the axis, the second surface having a second curvature with a second radius of curvature and center, the first curvature being different than the second curvature, the length being substantially greater than the maximum distance between the first surface of the roller and the second surface of the roller, and the maximum distance between the first and second surfaces of the roller being at least as great as half the distance between the centers of the first and second surfaces wherein the first curvature is circular and the second curvature is circular and the radius of the curvature of the surface being different from the radius of curvature of the second surface.

14. An exercise device comprising an elongated roller formed of a compressible material, a wholly convex outer surface, an longitudinal axis and a length in the direction of the axis, a curved first surface on one side of the axis, the first surface having a first curvature with a first radius of curvature and a center and a curved second surface on the other side of the axis, the second surface having a second curvature with a second radius of curvature and a center, the first curvature being different than the second curvature, the length being substantially greater than the maximum distance between the first surface of the roller and the second surface of the roller, and the maximum distance between the first and second surfaces of the roller being at least as great as half the distance between the centers of the first and second surfaces wherein the first surface has a first axis about which the first surface is formed and the second surface has a second axis about which the second surface is formed, and wherein the distance from the second axis to the second surface is greater than the minimum distance from the first axis to the second surface.

* * * * *